US008523185B1

(12) United States Patent
Gilbreath et al.

(10) Patent No.: US 8,523,185 B1
(45) Date of Patent: Sep. 3, 2013

(54) TARGET SHOOTING SYSTEM AND METHOD OF USE

(76) Inventors: Don Herbert Gilbreath, West Chester, PA (US); Conor Patrick Gilbreath, West Chester, PA (US)

( * ) Notice: Subject to any disclaimer, the term of this patent is extended or adjusted under 35 U.S.C. 154(b) by 68 days.

(21) Appl. No.: 13/374,258

(22) Filed: Dec. 19, 2011

Related U.S. Application Data

(60) Provisional application No. 61/462,467, filed on Feb. 3, 2011.

(51) Int. Cl.
*F41J 5/00* (2006.01)
*A63B 67/00* (2006.01)

(52) U.S. Cl.
USPC ..... 273/371; 273/348; 463/49; 434/23

(58) Field of Classification Search
USPC ..... 273/348–409; 434/11, 22, 23; 463/49, 463/52; 473/154, 190
See application file for complete search history.

(56) References Cited

U.S. PATENT DOCUMENTS

| | | | | | |
|---|---|---|---|---|---|
| 2,819,085 | A * | 1/1958 | Brown et al. | ..... | 273/373 |
| 2,916,289 | A * | 12/1959 | Zito | ..... | 273/372 |
| 4,222,564 | A * | 9/1980 | Allen et al. | ..... | 273/369 |
| 4,303,853 | A * | 12/1981 | Thalmann | ..... | 235/400 |
| 4,307,292 | A * | 12/1981 | Knight et al. | ..... | 235/400 |
| 4,349,729 | A * | 9/1982 | Knight | ..... | 235/400 |
| 4,350,881 | A * | 9/1982 | Knight et al. | ..... | 235/400 |
| 4,350,882 | A * | 9/1982 | Phillips | ..... | 235/400 |
| 4,357,531 | A * | 11/1982 | Knight | ..... | 235/400 |
| RE32,123 | E * | 4/1986 | Knight | ..... | 235/400 |
| 4,799,688 | A * | 1/1989 | Kellman et al. | ..... | 273/371 |
| 5,029,873 | A * | 7/1991 | Davis | ..... | 273/376 |
| 5,095,433 | A * | 3/1992 | Botarelli et al. | ..... | 273/372 |
| 5,462,283 | A * | 10/1995 | Allen | ..... | 273/371 |
| 6,322,365 | B1 * | 11/2001 | Shechter et al. | ..... | 434/21 |
| 6,367,800 | B1 * | 4/2002 | Sheck et al. | ..... | 273/372 |
| 6,604,946 | B2 * | 8/2003 | Oakes | ..... | 434/11 |
| 6,863,532 | B1 * | 3/2005 | Ambrosoli | ..... | 434/11 |
| 6,966,775 | B1 * | 11/2005 | Kendir et al. | ..... | 434/19 |
| 8,105,087 | B2 | 1/2012 | Valentini | | |
| 2002/0051953 | A1 * | 5/2002 | Clark et al. | ..... | 434/16 |
| 2003/0082502 | A1 * | 5/2003 | Stender et al. | ..... | 434/23 |
| 2003/0134700 | A1 * | 7/2003 | Salva | ..... | 473/476 |
| 2005/0017456 | A1 * | 1/2005 | Shechter | ..... | 273/371 |
| 2009/0194943 | A1 * | 8/2009 | Amitai et al. | ..... | 273/373 |
| 2012/0043722 | A1 * | 2/2012 | Mironichev et al. | ..... | 273/406 |

* cited by examiner

*Primary Examiner* — Milap Shah
(74) *Attorney, Agent, or Firm* — Ted Masters

(57) ABSTRACT

A target shooting system includes a gun which shoots a projectile at a target which is part of a target assembly. The target includes a sensor which senses a projectile hit, and passes an electronic signal to a target information processor located in the target assembly. The target information processor processes the hit information, and transmits a target hit signal to a system processor over a wireless rf link. The system processor stores and displays the hit information, and broadcasts a hit announcement to the shooter.

24 Claims, 12 Drawing Sheets

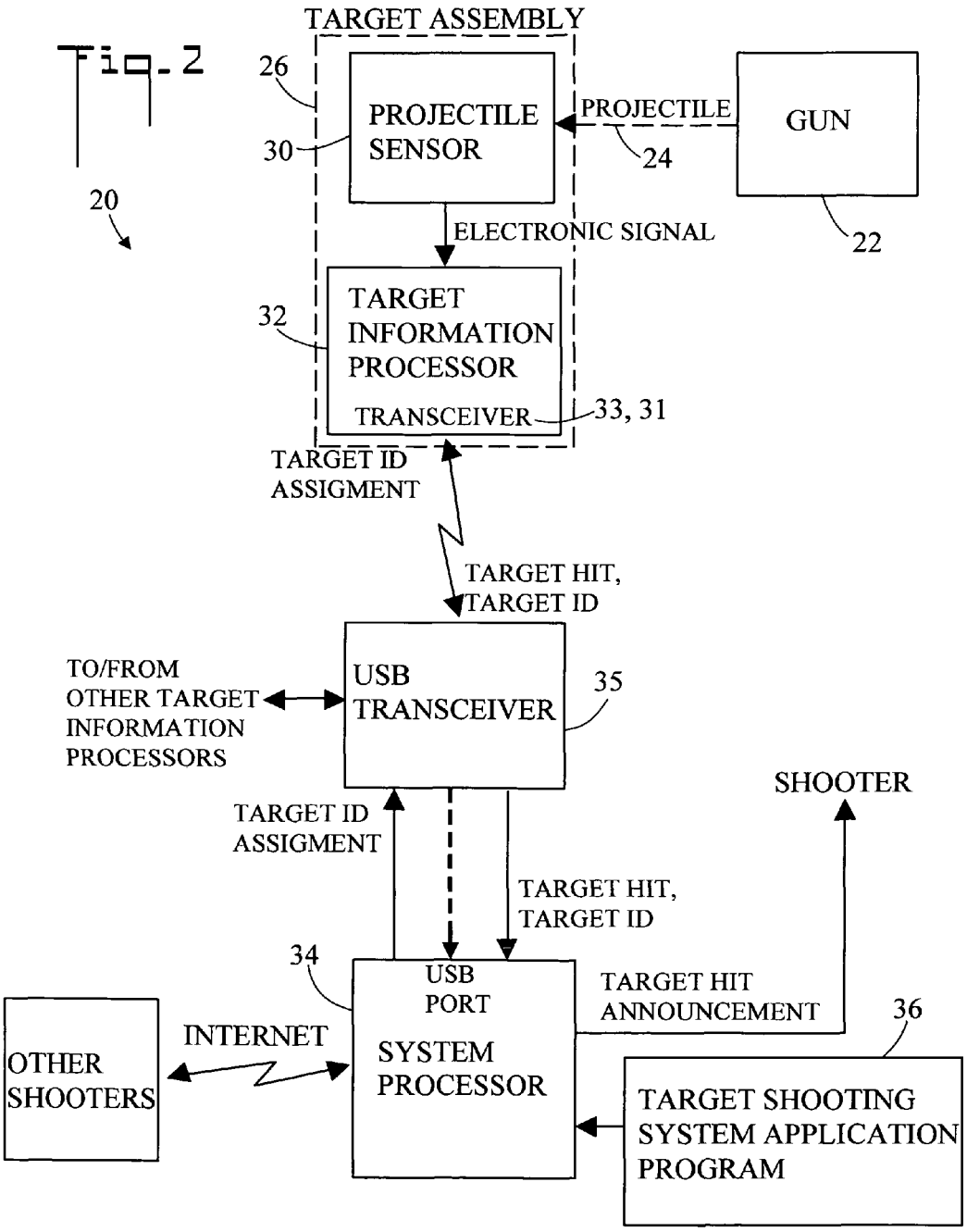
Fig. 2
20
TARGET ASSEMBLY
26
PROJECTILE SENSOR
30
PROJECTILE
24
GUN
22
ELECTRONIC SIGNAL
32
TARGET INFORMATION PROCESSOR
TRANSCEIVER
33, 31
TARGET ID ASSIGMENT
TARGET HIT, TARGET ID
TO/FROM OTHER TARGET INFORMATION PROCESSORS
USB TRANSCEIVER
35
SHOOTER
TARGET ID ASSIGMENT
TARGET HIT, TARGET ID
34
USB PORT
SYSTEM PROCESSOR
TARGET HIT ANNOUNCEMENT
36
INTERNET
OTHER SHOOTERS
TARGET SHOOTING SYSTEM APPLICATION PROGRAM TARGET ASSEMBLY
26
PROJECTILE SENSOR
30
PROJECTILE
24
GUN
22
20
ELECTRONIC SIGNAL
TARGET INFORMATION PROCESSOR
TRANSMITTER
33
SHOOTER
TARGET HIT, TARGET ID
31
RECEIVER
TARGET HIT ANNOUNCEMENT
FROM OTHER TARGET INFORMATION PROCESSORS
SYSTEM PROCESSOR
34
36
TARGET SHOOTING SYSTEM APPLICATION PROGRAM

USB TRANSCEIVER

TARGET SHOOTING SYSTEM AND METHOD OF USE

CROSS REFERENCE TO RELATED APPLICATION

This application claims the filing benefit under 35 U.S.C. §119(e) of U.S. Provisional Application No. 61/462,467, filed Feb. 3, 2011, which is hereby incorporated by reference.

TECHNICAL FIELD

The present invention pertains generally to target shooting, and more particularly to a target shooting system which allows shooter control and provides target hit feedback.

BACKGROUND OF THE INVENTION

Target shooting is a sport which is enjoyed by many people throughout the world. Target shooting can range from simple backyard target practice for entertainment, to highly competitive shooting contests. One form of target shooting employs guns such as airsoft guns. Airsoft guns typically comprise replica firearms (rifles and pistols) which shoot plastic projectiles (also known as pellets) by way of compressed gas, electric motors, or spring-driven pistons. Common uses for airsoft guns are competitive gaming (similar to paintball), military simulations, target shooting, military training, and recreation. While similar in operation to BB guns, airsoft guns fire lightweight plastic projectiles 6 mm in diameter instead of metallic 4.5 mm BBs. Airsoft guns also typically have a muzzle velocity of less than 180 m/s (600 ft/s), compared to a BB gun which may have a muzzle velocity of 365 m/s (1200 ft/s) or more. The combination of the lighter projectiles and the reduced muzzle velocity means that airsoft guns are generally considered safe when used in a controlled environment and with safety equipment like protective eyewear. In many applications, airsoft guns are used in conjunction with targets such as paper targets, mechanical targets, and the like.

BRIEF SUMMARY OF THE INVENTION

The present invention is directed to a an interactive digitally addressable wireless target shooting system with embedded sensors, processor, and radio link for detecting and transmitting target hit information back to the shooter. A remotely mounted target assembly which can have multiple targets, detects airsoft pellet hits of a particular target, and transmits resultant target data over an addressable radio link to a computer device which gives the shooter feedback with either recorded audio, synthesized audio, or tactical feedback. A software application is active on the computer device, smart phone or internet website with different target training exercises including speed, precision, endurance, and multiplayer operations both locally and networked on the internet.

The target assembly includes a microprocessor, radio link with addressing capability and embedded sensors attached to wood or other materials as remote targets for scoring time and accuracy of small ammunition fired at distance for training and entertainment. The target shooting system can use the internet as part of individual scoring or multi player internet based competition with dynamic audio and or tactical feedback from a computing device. The target shooting system can start out as a simple consumer target system and can scale to shooting ranges, law enforcement, military training exercises such as "room clearing" and other field operations and entertainment equivalents utilizing personal audio, public address audio or vibration form a receiving device for reactive feedback of a normally quite pellet shot from an airsoft gun.

In accordance with an embodiment, a target shooting system includes a gun which shoots a projectile. The target shooting system also includes a target assembly which has at least one target having a projectile sensor. The projectile sensor produces an electronic signal when a projectile shot by the gun hits the target. The target assembly further includes a target information processor which is connected to the projectile sensor. The target information processor receives and processes the electronic signal, and includes a transmitter which transmits a target hit signal when a projectile hits the target. The target shooting system further includes a system processor (such as a laptop computer) which has a receiver which receives the target hit signal from the target information processor, and when the target hit signal is received, outputs a target hit announcement.

In accordance with another embodiment, the target assembly includes a plurality of targets wherein each projectile sensor is connected to the target information processor.

In accordance with another embodiment, the target information processor includes a debounce detector which detects when a single projectile hits two targets.

In accordance with another embodiment, the target information processor transmitter also transmits a target ID along with the target hit signal. The system processor receives the target ID along with the target hit signal.

In accordance with another embodiment, the system processor receives target hit signals and target IDs from a plurality of target assemblies.

In accordance with another embodiment, the target included a striker plate which has a front side and a rear side, the projectile sensor connected to rear side of the striker plate.

In accordance with another embodiment, the striker plate is fabricated from hardwood.

In accordance with another embodiment, the target assembly includes a frame to which the striker plate is removably connected. The frame includes a cavity so that when the striker plate is connected to the frame the projectile sensor is adjacent to the cavity.

In accordance with another embodiment, a plurality of striker plates are disposed in side-by-side spaced apart relationship.

In accordance with another embodiment, the projectile sensor includes a piezoelectric device.

In accordance with another embodiment, the target information processor includes an analog-to-digital converter which processes the electronic signal received from the projectile sensor.

In accordance with another embodiment, the target hit announcement includes at least one of (1) an audio announcement, and (2) a tactile announcement.

In accordance with another embodiment, a target shooting system application program is installed on the system processor, the target shooting application program for monitoring and controlling target shooting system operation.

In accordance with another embodiment, the target shooting system is connected to the internet, and the target shooting system application program is accessed by going to an internet website.

In accordance with another embodiment, the target shooting system application program causes the system processor to display target shooting system information.

In accordance with another embodiment, the target shooting system is connected to the internet, and the system processor is connected to system processors of other shooters via the internet.

In accordance with another embodiment, the target information processor includes a receiver, and the system processor includes a transmitter.

In accordance with another embodiment, the system processor has a USB port. The transmitter and the receiver of the system processor is a USB transceiver which plugs into the USB port.

In accordance with another embodiment, a target ID assignment is sent from the transmitter of the system processor to the receiver of the target information processor. The target ID assignment causes a target ID to be assigned to a target by the target information processor.

In accordance with another embodiment, the invention comprises a target assembly, the target assembly cooperating with a gun which shoots a projectile, a system processor, and a target shooting system application program.

Other embodiments, in addition to the embodiments enumerated above, will become apparent from the following detailed description, taken in conjunction with the accompanying drawings, which illustrate, by way of example, the principles of the target shooting system and method of use.

BRIEF DESCRIPTION OF THE DRAWINGS

FIG. 2 is a block diagram of the target shooting system;

DETAILED DESCRIPTION OF THE INVENTION

Figure 1:
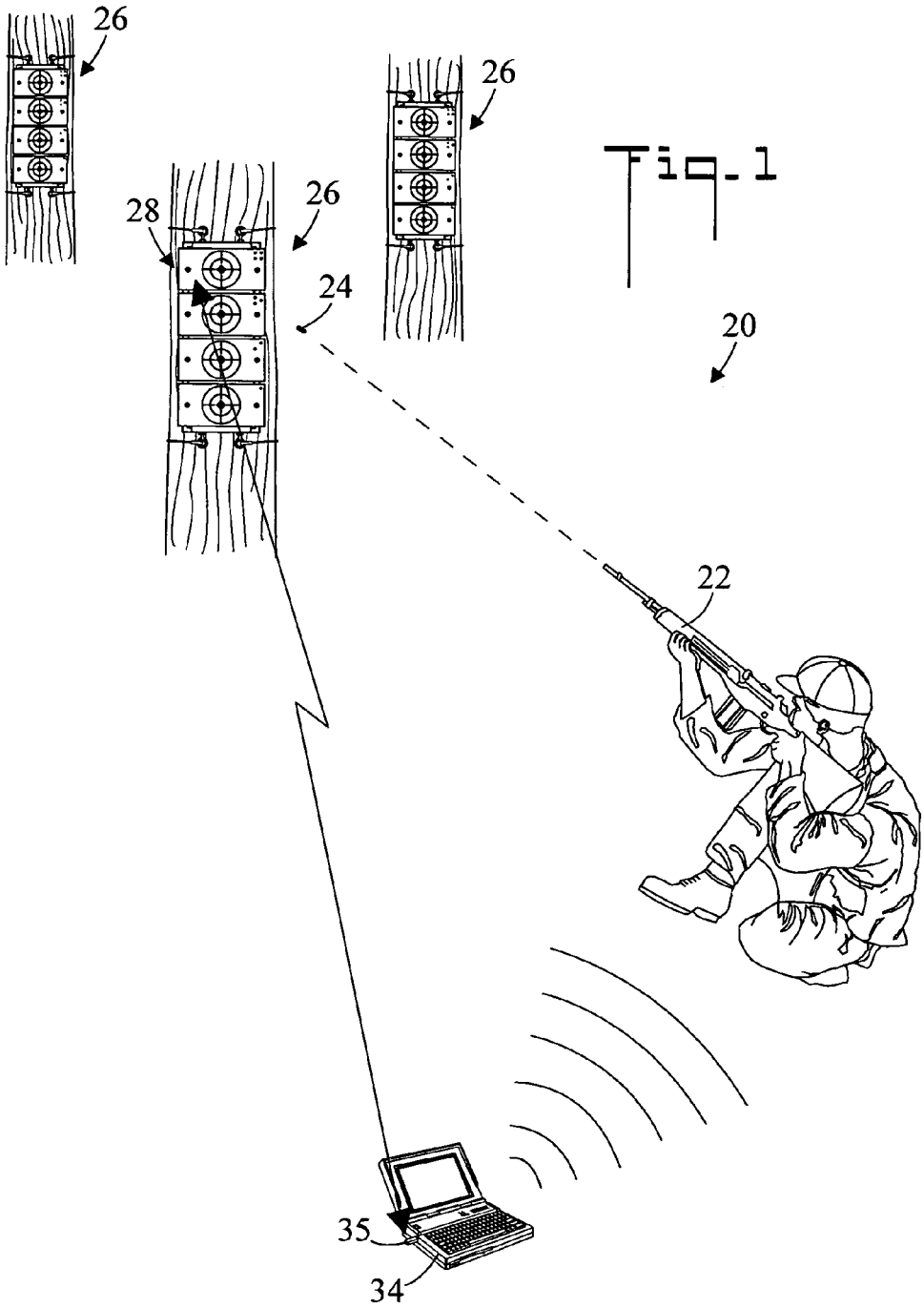
FIG. 1 is a pictorial diagram of a target shooting system in accordance with the present invention.

Referring initially to FIGS. 1 and 2, there are illustrated pictorial and block diagrams respectively of a target shooting system in accordance with the present invention; generally designated as 20. Target shooting system 20 includes a gun 22 which shoots a projectile 24. In the shown embodiment gun 22 is an airsoft gun which shoots plastic projectiles 24. It may be appreciated however that other types of target shooting guns 22 and projectiles 24 could also be utilized in target shooting system 20 (e.g. BB guns). Target shooting system 20 further includes a target assembly 26 (also refer to FIGS. 4-9 and the associated discussions) which includes at least one target 28 (also refer to FIGS. 10-14 and the associated discussions). Target 28 includes a projectile sensor 30 which produces an electronic signal when a projectile 24 shot by gun 22 hits target 28.

A target information processor 32 is connected to projectile sensor 30. Target information processor 32 receives and processes the electronic signal from projectile sensor 30 (also refer to FIG. 15 and the associated discussion). Target information processor 32 includes a radio frequency (rf) transmitter 33 (which can be a transceiver, refer to FIG. 15) which transmits a target hit signal to a system processor 34 when a projectile 24 hits target 28. In the shown embodiment, target information processor 32 transmitter 33 also transmits a target ID along with the target hit signal, which is also received by system processor 34. In an embodiment, target shooting system 20 utilizes the 2.40-2.4835 gHz rf transmission band. Typically the target ID comprises a specific rf channel to which target 28 is assigned, along with a character set (e.g. 1111, 2222, AAAA, 1478) which identifies the particular target 28.

Target information system 20 further includes a system processor 34 which has a rf receiver 35 which receives the target hit signal from target information processor 32, and when the target hit signal is received outputs a target hit announcement. System processor 34 can be a desktop computer, a laptop computer, a smart phone, a pad-type computer, or any other digital processor, and is typically located within earshot of the shooter. The target hit announcement can be at least one of (1) an audio announcement (such as the sound of a shooting gun), and (2) a tactile announcement (such as through vibration of a smart phone). The audio announcement could also be wirelessly transmitted to an audio device such as a stereo system, or to an ear piece of a phone or other electronic device. In areas having high ambient noise which would mask an audio announcement, the target hit announcement can be transmitted using a Bluetooth connection to an electronic device such as a cell phone having an ear piece. The system processor can also display a hit announcement on a screen (refer to FIG. 19). Further it is noted that, system processor 34 can receive target hit signals and target IDs from a plurality of target assemblies 26.

In the shown embodiment, target information processor 32 also includes a receiver 31, and system processor 34 includes a transmitter 33 (included in transceiver 35). That is, both target information process 32 and system processor 34 contain transceivers which provided for two way information exchange. A target ID assignment is sent from the transmitter 33 of system processor 34 to the receiver 31 of target information processor 32. The target ID assignment causes a target ID to be assigned to a particular target 28 by target information processor 32. In the shown embodiment, a USB transceiver 35 is plugged into a USB port on system processor 34 to effect the two-way communication with target information processor 32.

Also in the shown embodiment, target shooting system 20 includes a target shooting system application program 36 (software) which is installed on system processor 34. Target shooting application program 36 provides monitoring and control of target shooting system 20 operation. In one embodiment, target shooting system application program 36 is contained on computer storage media (such as a CD) which can be directly loaded on system processor 34. In another embodiment, target shooting system 20 is connected to the internet, and target shooting system application program 36 is accessed by going to an internet website. In another embodiment, when system processor 34 is connected to the internet, it can be connected to system processors 34 of other remote shooters (such as in other cities or countries). With such a connection, target shooting system information (such as target hit signals, target ID, target ID assignment, etc.) can be exchanged with the other shooters, thereby creating a networked target shooting system. With the networked target shooting system, it is possible to for the shooters to participate in various shooting competitions and games. When target shooting system 20 is on a small network, other theatrical feedback effects are also possible (such as smoke, lights, doors, other sounds form distributed sound devices, and the like).

Figure 3:
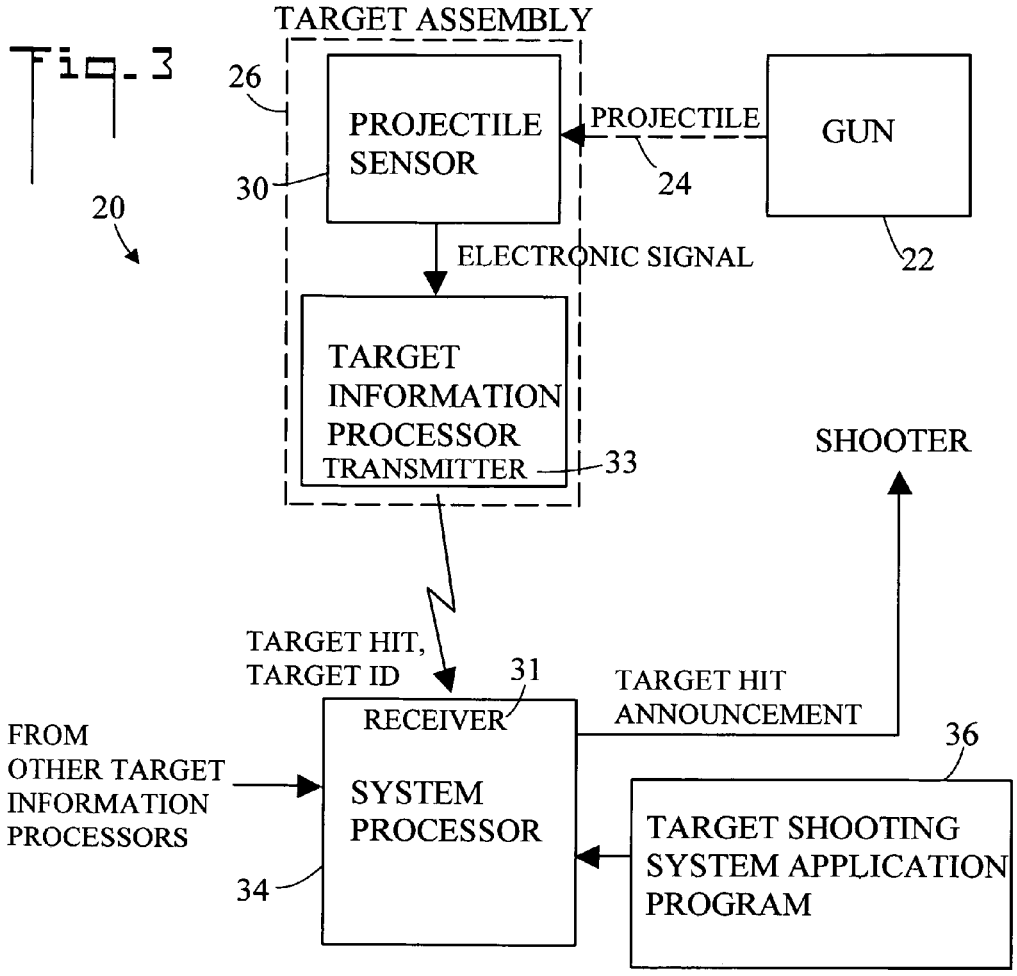
FIG. 3 is a block diagram of a second embodiment of the target shooting system.
Figure 4:
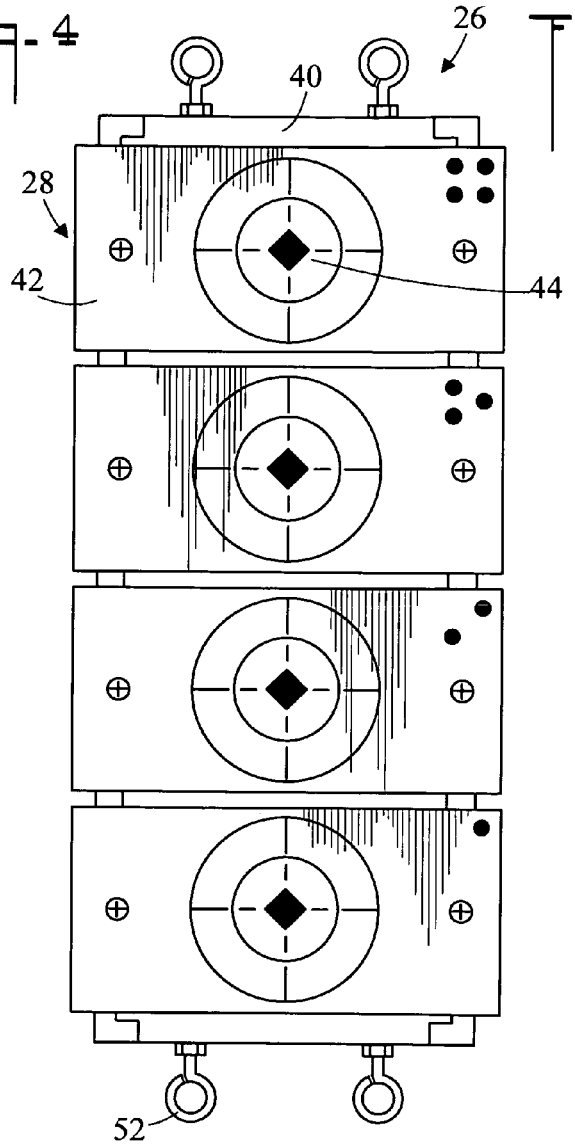
FIG. 4 is a front side elevation view of a target assembly.
Figure 5:
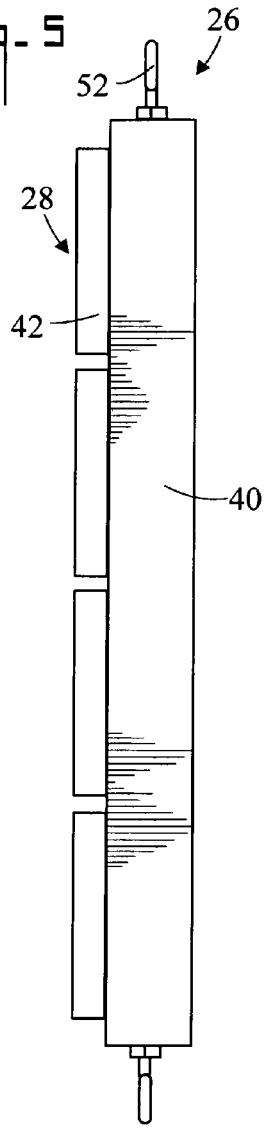
FIG. 5 is an edge elevation view of the target assembly.
Figure 6:
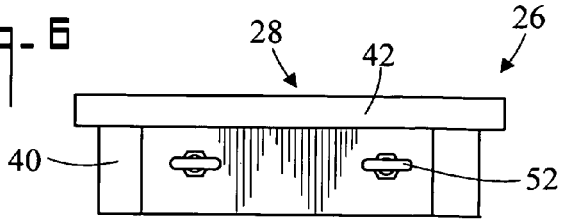
FIG. 6 is an end elevation view of the target assembly.
Figure 7:
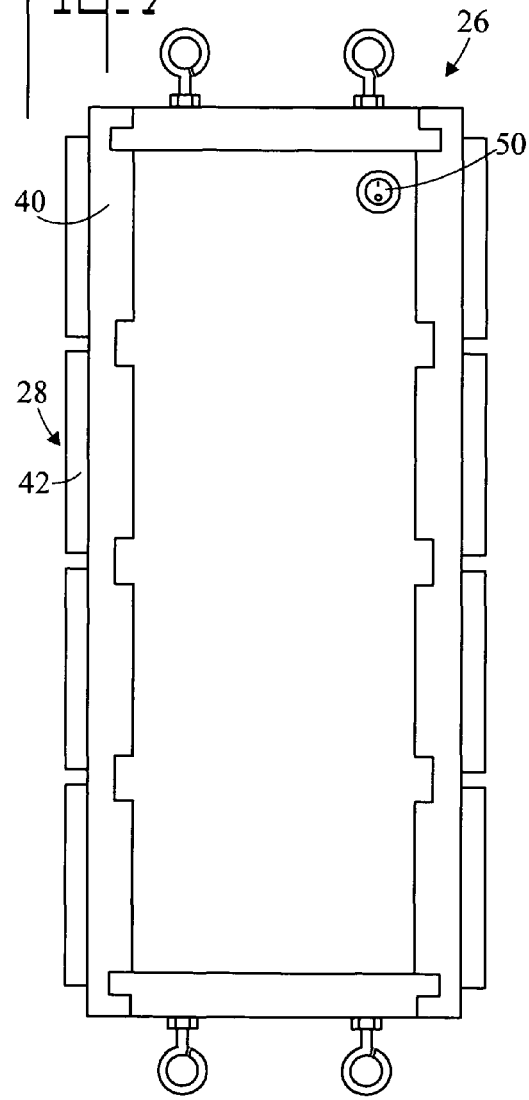
FIG. 7 is a rear side elevation view of the target assembly.
Figure 8:
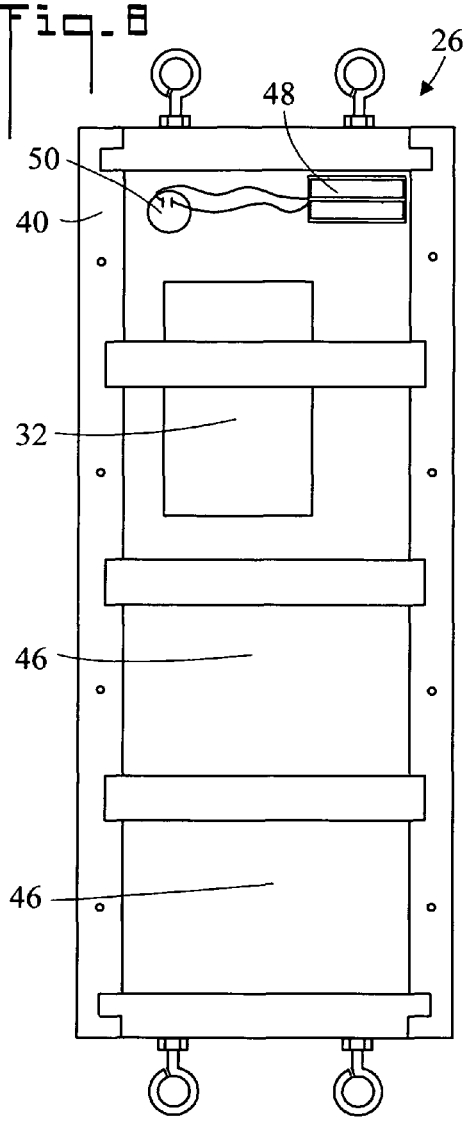
FIG. 8 is an open front side elevation view showing the inside of the target assembly.
Figure 9:
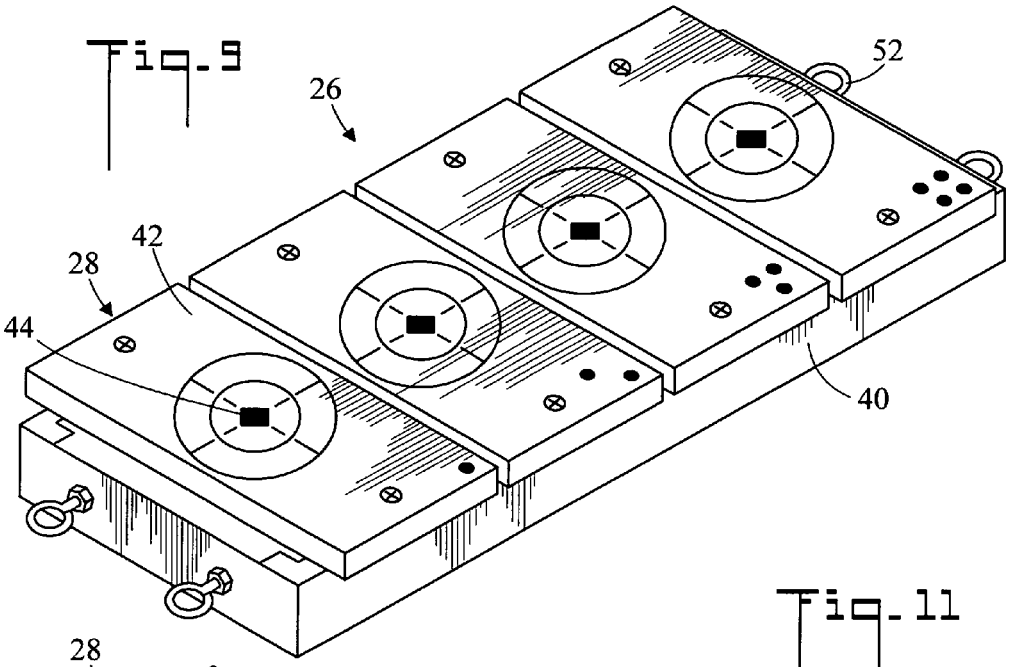
FIG. 9 is a perspective view of the target assembly.

FIG. 3 is a block diagram of a second embodiment of the target shooting system. In this embodiment, the target ID assignment feature of FIG. 2 is not provided, and transmission is one way between target information processor 32 and system processor 34. Also in this embodiment, receiver 31 of system processor 34 is embedded in system processor 34, rather than being a separate element plugged into a USB port as in FIG. 2. And finally, there is no internet connection to other shooters in the second embodiment. However, it may be appreciated that the various features disclosed in FIGS. 2 and 3 may be combined in other ways to form other embodiments of target shooting system 20. For example the embedded receiver feature of FIG. 3 could replace the USB transceiver 35 feature of FIG. 2, and so forth.

Now referring to FIGS. 4-9, there are illustrated front side elevation, edge elevation, end elevation, rear side elevation, open front side elevation, and perspective views respectively of target assembly 26. Target assembly 26 includes one or more targets 28 at which the shooter shoots. Target assembly 26 includes a frame 40 to which at least one target 28 is removably connected (four targets 28 in the shown embodiment). Target 28 includes a striker plate 42 upon which target indicia 44 (e.g. a bullseye) is disposed. In the shown embodiment a plurality of striker plates 42 are disposed in side-by-side spaced apart relationship. Frame 40 includes a cavity 46 (FIG. 8) so that when striker plate(s) 42 is connected to frame 40 the projectile sensor 30 located on the back of striker plate 42 is adjacent to cavity 46 (refer also to FIG. 11 and the associated discussion). Cavity 46 serves as a resonate cavity tuned to the frequency of projectile 24 striking striker plate 42 of target 28. This is similar to an acoustic drum that is tuned by the tightness of the skin of the drum. In this design approximately 5 cubic inches air space (per target 28) is provided based on the 3×7 in dimensions of target 28.

In addition to targets 28, target assembly 26 also includes projectile sensors 30 (one for each target 28, refer to FIG. 11), and target information processor 32 which in turn includes receiver 31, and transmitter 33. Target assembly further includes a power source 48 (such as batteries), and an OFF/ON switch 50. Target assembly 26 further includes mounts 52 which are utilized to mount target assembly 26 to a tree or other support structure such as with bungee cords (refer to FIG. 1). Mounting may either be vertical as is shown in FIG. 1, or horizontal.

Figure 10:
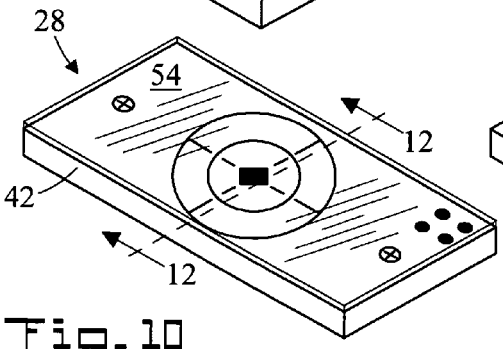
FIG. 10 is a front perspective view of a target.
Figure 11:
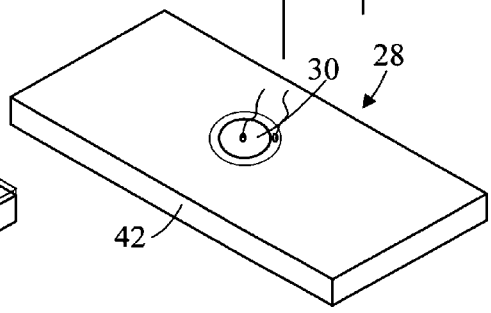
FIG. 11 is a rear perspective view of the target.

FIGS. 10 and 11 are front perspective and rear perspective views respectively of target 28. Target 28 comprises a multi-layered structure which is removably attached to frame 40 (refer to FIG. 9). The shooter aims at target 28, and a hit is measured by projectile sensor 30 which senses the force of projectile 24 hitting the hard wood striker plate 42 or other material surface at close and long distance with a muzzle velocity of 180-600 fps typical of airsoft guns. Projectile sensor 30 is connected to the rear side of striker plate 42 and senses projectile 24 striking the front side of target 28. In an embodiment, a hit will be registered if projectile 24 hits within an area which is about the size of a 50 cent piece, however the size of the hit area can be adjusted with component value changes in A/D converter 60 (refer to FIG. 15 and the associated discussion). A protective clear sheet 54 (such as Lexan™) covers the front side of striker plate 42. The shooter shoots at target indicia 44 which is placed between protective clear sheet 54 and striker plate 42. In an embodiment, striker plate 42 is fabricated from a hardwood such as hickory, and is about 3 inches wide, 7 inches long, and ⅜ inches thick.

Projectile sensor 30 is adhered to the rear side of striker plate 42 with epoxy or hot glue. Striker plate 42 protects projectile sensor 30 from direct contact with projectile 24, while also dampening and magnifying the projectile strike area. Wires are soldered to the piezoelectric sensor 30 which connect it to target information processor 32 (refer to FIG. 2).

Figure 12:
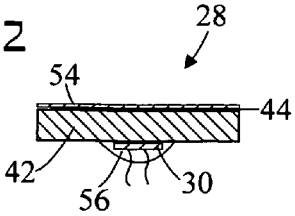
FIG. 12 is cross sectional view along the line 12-12 of FIG. 10.

FIG. 12 is cross sectional view of target 28 along the line 12-12 of FIG. 10, showing striker plate 42, projectile sensor 30, protective sheet 54, and target indicia 44. To minimize moisture and water damage to projectile sensor 30 in an outdoor setting, a protective cover 56 such as rubber surrounds either the entire target assembly 26 cavity, or as shown surrounds projectile sensor 30.

Figure 13:
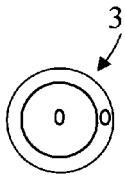
FIG. 13 is an enlarged top plan view of a projectile sensor.
Figure 14:
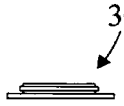
FIG. 14 is an enlarged side elevation view of the projectile sensor.

FIGS. 13 and 14 are enlarged top plan and enlarged side elevation views respectively of projectile sensor 30, which is the shown embodiment is a piezoelectric device. In one embodiment, projectile sensor 30 is a piezoelectric device which is found typically in audio applications for battery operated consumer devices like watches, game machines but used in reverse in this application. The piezoelectric device is about 2.0 cm in diameter with two wires attached to ceramic and brass outer ring. Alternately, the target 28 surface may be solid materials notably quartz crystals, certain ceramics, or biological matter such as bone which responds like a piezoelectric device to applied mechanical strain.

Figure 15:
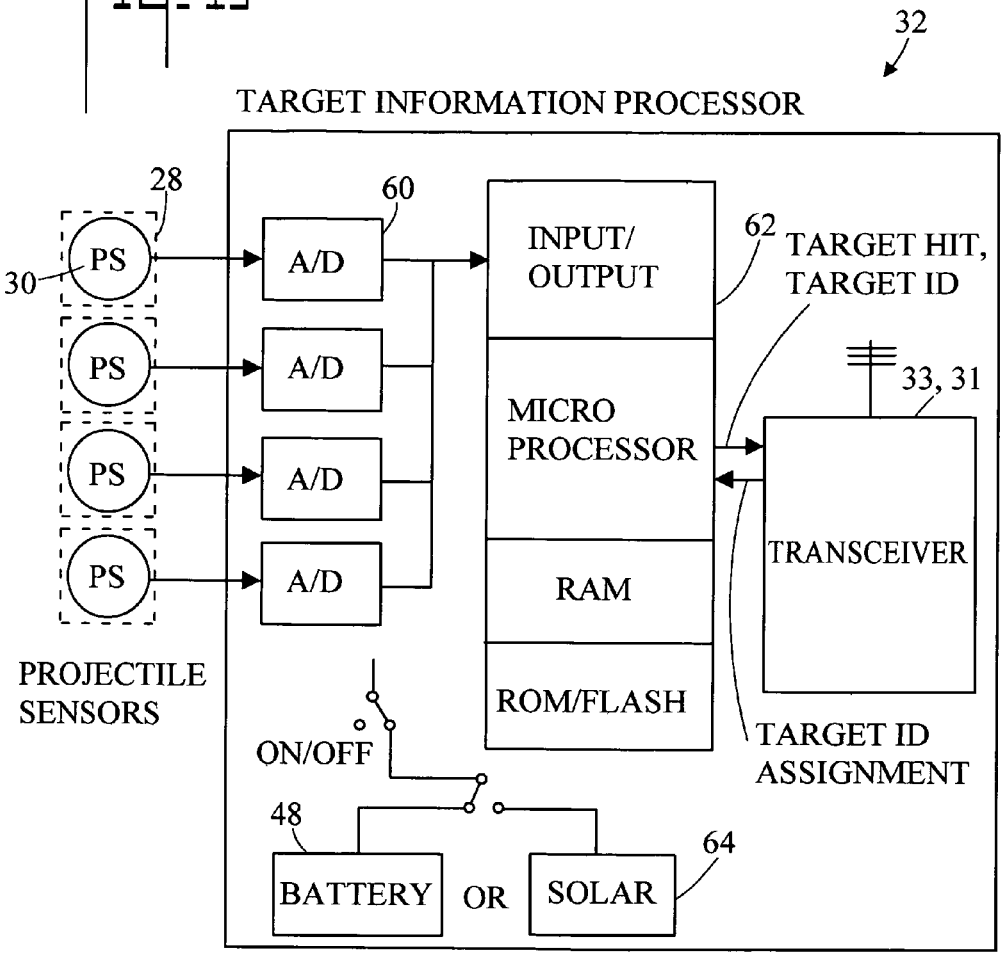
FIG. 15 is a block diagram of projectile sensors and a target information processor.

FIG. 15 is a block diagram of projectile sensor 30 and target information processor 32. These elements are housed in target assembly 26 (refer to FIGS. 4-9). In the shown embodiment, target assembly 26 (refer to FIG. 2) includes a plurality of targets 28 wherein each projectile sensor 30 is connected to target information processor 32. The electronic circuitry housed within target assembly 26 includes the following elements:

- Projectile sensors 30, one connected to each target 28
- Analog-to-digital (A/D) converters 60, one for each projectile sensor 30
- Low power consumption microprocessor 62
- Ultra low power rf transceiver 33, 31
- Power supply 64

Projectile sensors 30 includes a piezoelectric device to which a small DC bias is presented at approximately 50% of the battery level. When a projectile 24 hits striker plate 42 of target 28, this signal falls below 30% and triggers A/D converter 60. In an embodiment, a Murata Manufacturing Co. Model #7BB-20-6 piezoelectric device is employed.

Target information processor 32 includes an analog-to-digital (A/D) converter which process the electronic signal received from projectile sensor 30. In the shown embodiment target assembly has four targets 28 and therefore four projectile sensors 30, each of which is connected to a separate A/D converter 60. Also referring to FIG. 16, A/D converter 60 comprises a monostable pulse generator where the width of the output pulse is determined by the time constant of an RC network, which consists of a capacitor (C) and a resistor (R). The output pulse ends when the voltage on the capacitor equals ⅔ of the battery voltage. The output pulse width can be lengthened or shortened to the need of the specific performance desired by adjusting the values of R and C.

The output pulse width of time t, which is the time it takes to charge C to ⅔ of the supply voltage, is given by:

$$t=RC\ln(3)\approx 1.1RC$$

where t is in seconds, R is in ohms and C is in farads.

This circuit timing is empirically set to deal with four projectile 24 shots/sec or 240 projectile shots/minute. The pulse width timing was set to minimize the microprocessor on time for minimum power consumption and maximize the count of projectiles fired at target 28.

Target information processor 32 further includes a microprocessor 62. In an embodiment, microprocessor 62 is an ultra low power; low voltage micro-controller such as the Freescale© MC9S08 series which is mature from a software coding point of view, friendly with battery operation with many built in power saving techniques including sleep until external wakeup. This feature with software allows a rapid sensing of an external event as required in this circuit, build the code table, transmit and resume low power operation as a sequence. The role of microprocessor 62 is:

1. Read shooter settings for sub channel address which is a switch on target assembly 32, or transmitted from system processor 34 (refer to FIG. 2). The sub channel address is part of the target ID.
2. Wait for target 28 to detect a projectile 24 hit.
3. Communicate a target hit and target ID to transmitter 33 for subsequent rf transmission to system processor.
4. After a hit, return all circuits to low power mode and wait for another hit.

Microprocessor 62 of target information processor 32 includes a debounce detector which detects when a single projectile 24 hits two targets 28, such as by ricochet. The debounce feature is in part accomplished by A/D converter 60 which extends (broadens) the short time of microseconds of a projectile sticking target 28, to milliseconds for measurement and de-bounce of pellets (refer to FIG. 17). In essence, the debounce detector rejects a second hit signal which occurs within a specified time of a first hit signal.

In the shown embodiment, rf transmitter 33 and rf receiver 31 are included in an ultra low power single chip 2.4 GHz transceiver such as Nordic© nRF24L01 series integrated circuit. The nRF24L01+ is a single chip 2.4 GHz transceiver with an embedded baseband protocol engine suitable for ultra low power wireless applications. The nRF24L01 is designed for operation in the world wide ISM frequency band at 2.400-2.4835 GHz. Suitable for 126 RF channels native, and further dividable into 10 sub channels, which result in a theoretical channel separation of 1260 channels for close proximity of targets. The channel allocation can either be transmitted from system processor 34, or could be made by a shooter-selectable switch provided on target assembly 26 (not shown).

Target information processor 32 further includes a power supply and optional energy harvest (solar power) section. Target assembly 26 is battery operated by 2 AAA batteries 48. A goal is to leave target assembly 26 turned on and left in an outdoor setting. To this end, a solar harvest version 64 can be provided which will survive 5 years of operation outdoors. With a simple switch on target information processor, a shooter can either use non recharge alkaline batteries or a low self discharge NiMH with build in solar panel.

Referring to FIGS. 1-15, the sequence of events in target shooting system 20 includes: a shooter aims gun 22 at the target artwork 44 of target assembly 26, which is protected by a clear protective sheet 54. When a projectile 24 hits target 28, projectile sensor 30 acquires a charge by mechanical stress (e.g. compression), vibration, and acoustic sound of projectile 24, and produces an electronic signal. That is, projectile sensor 30 serves as a transducer which converts the mechanical energy of the projectile 24 strike into an electrical signal. The electronic signal output of projectile sensor 30 is routed to the input section (A/D converter) of target information processor 32. The electronic hit signal is processed and shaped and then routed to microprocessor 62. Low power, low voltage microprocessor 62 is then utilized to orchestrate all computational processes such as reading all targets 28, preparing a code sequence based on preset software addresses and shooter adjustable sub-channel address of the target 28, and communications with the rf transceiver) circuitry. The rf transceiver is responsible for preparing all this data and transmitting very small data payload of 6-32 bytes of information to the USB transceiver 35 of system processor 34. This small payload data size is relevant to the low latency of data transmitted and the low power consumption of target shooting system 20. USB transceiver 35 is plugged into a standard USB connector on system processor (computer device) 34. System processor 34 uses the target hit and target ID information to (1) broadcast a target hit announcement (audio or tactile) to the shooter, (2) process and display target hit information, and (3) if in a networked environment, transmit and receive target hit information to and from other shooters.

Figure 16:
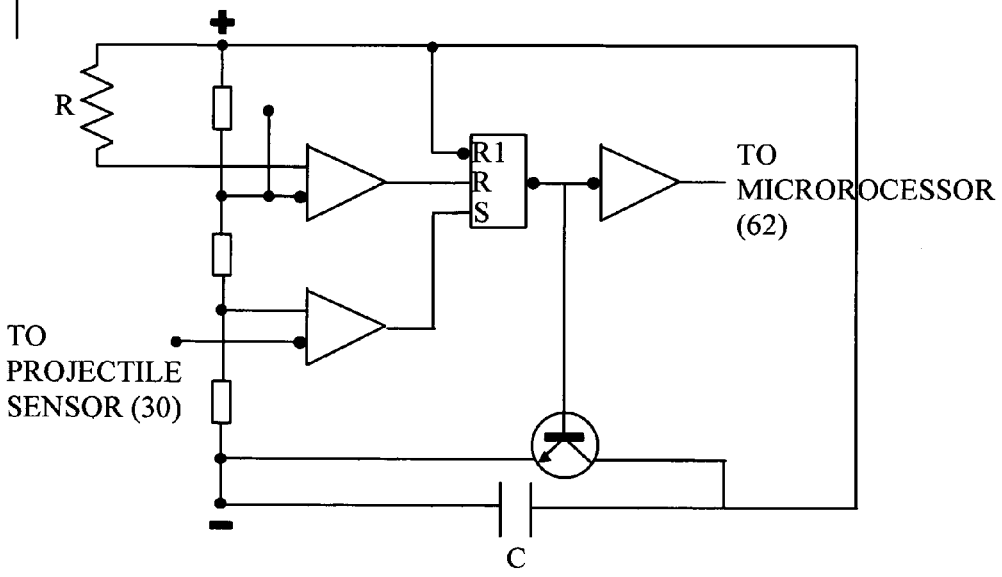
FIG. 16 is a schematic diagram of an A/D converter.

FIG. 16 is a schematic diagram of A/D converter 60 which receives an electronic signal from projectile sensor 30, and processes and shapes the signal for delivery to microprocessor 62.

Figure 17:
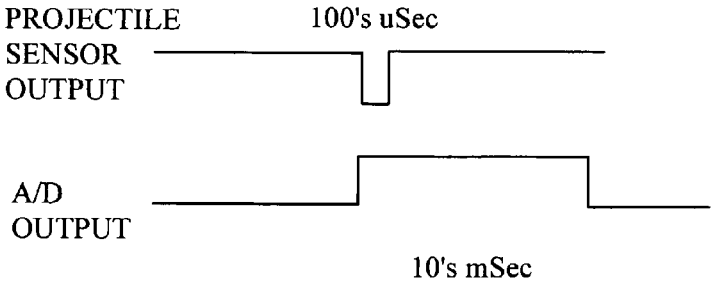
FIG. 17 is a timing diagram of a projectile sensor output electronic signal, and the processed output of an A/D converter.

FIG. 17 is a timing diagram of projectile sensor 30 output electronic signal, and the processed output of A/D converter 60. The electronic signal from projectile sensor 30 is lengthened for subsequent processing in microprocessor 62. A/D converter 60 amplifis the electronic hit signal from projectile sensor 30, and adds time enhancements for a signal duration that starts out in microseconds form a pellet hitting the surface of the target of measurements extended to hundreds of milliseconds or long enough signal and time conditioning suitable for microprocessor 62 to scan many targets 28 which may be part of the target assembly 26.

Figure 18:
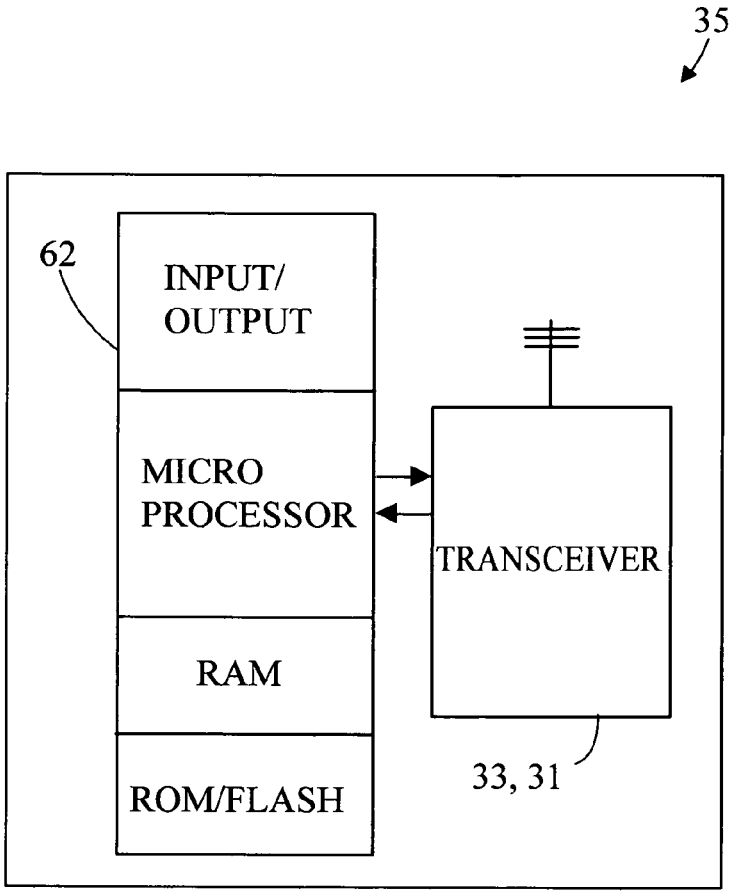
FIG. 18 is a block diagram of a USB transceiver.

FIG. 18 is a block diagram of USB transceiver 35 (refer to FIG. 2). System processor 34 includes a USB port. The transmitter 33 and receiver 31 of system processor 34 are contained within USB transceiver 35 which is plugged into the USB port of system processor 34. In an embodiment, USB transceiver 35 contains the same microprocessor 62 as target information processor 32 (refer to FIG. 15 and the associated discussion), and also the same transmitter 33 and receiver 31 as target information processor 32.

Figure 19:
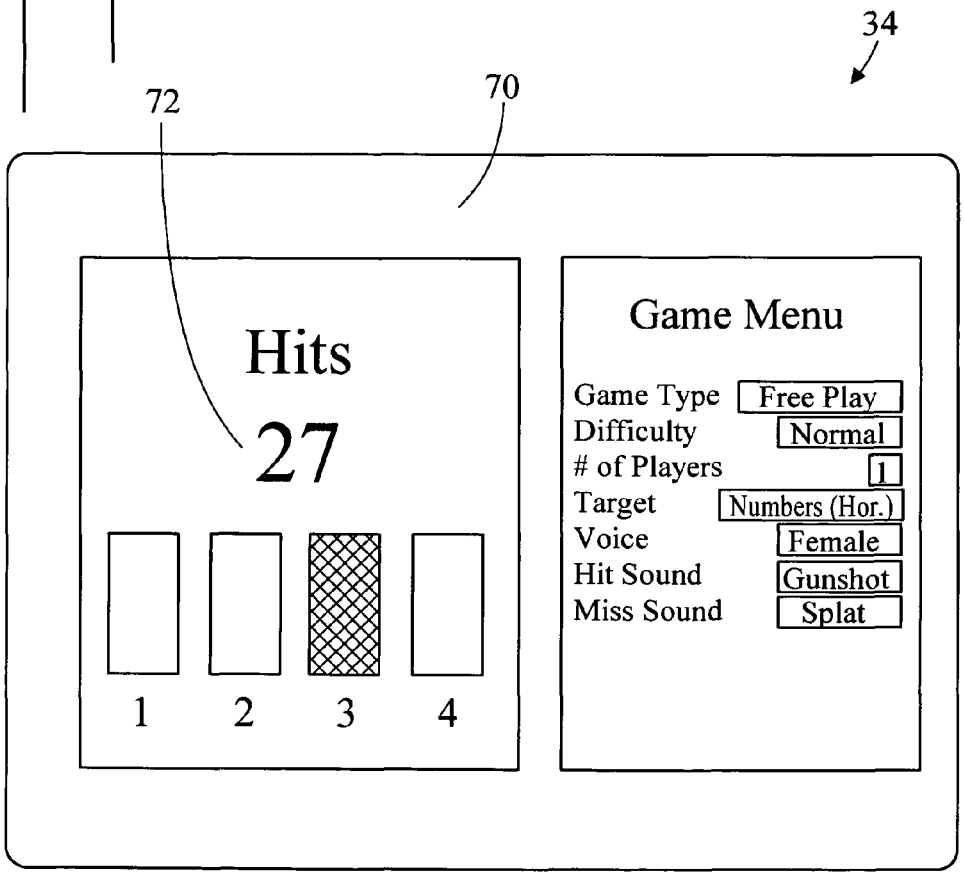
FIG. 19 is a diagram of a screen on a system processor displaying target shooting system information.

FIG. 19 is a diagram of a screen 70 on system processor 34 displaying target shooting system information. Target shooting system application program 36 causes system processor 34 to display a target shooting scoreboard 72 (target scoring system) as well as other target shooting system 20 information. In the shown embodiment, the target shooting system scoreboard 72 indicates the total number of times a target assembly 26 has been hit (e.g. 27 times), and further shows (by a colored light) which target 28 has just been hit (e.g. target #3). Other target shooting system information such as selectable game parameters of game type, difficulty, # of players, target, voice type for target hit announcement, hit sound, and miss sound. The target shooting system application program 36 which controls the system processor 34 display can either be accessed by going to an internet website (e.g. www.shootmyash.com), or directly loading the application program into system processor 34. In normal operation, the shooter is not expected to be looking at the system processor 34 except at the beginning and end of a shooting sequence, and therefore audio feedback and sound effects are key to this application and scenario.

As target shooting system 20 is interactive by design in terms of training or entertainment there are many possible scenarios of how it can be utilized, as is described below: (also refer to FIGS. 1-15)

Scenario 1:

The shooter wants to train with random audibly-directed targets 28 to aim at for some amount of time.

1. A target assembly 26 is mounted to a structure such as a tree and turned on.
2. A supplied USB radio transceiver 35 is plugged into system processor 34 (e.g. a laptop computer or other computing device such as a cell phone carried by the shooter).
3. The shooter selects this particular game type from software 36 running on laptop 34 from a pull down menu.
4. An audio signal from the laptop 34 directs the shooter audibly which target 28 to shoot at.
5. The shooter aims gun 22 and shoots at the directed target 28.
6. A projectile 24 is fired by the shooter with an expected muzzle velocity of 180-600 fps at the target 28.
7. The target assembly 26 has one or more targets 28 which can detect when projectile 24 hits the target 28.
8. A hit is sensed by projectile sensor 30 and passed to A/D converter 60 for signal conditioning. Microprocessor 62 then converts the hit into a code structure which looks like key codes utilizing a standard convention that any web browser can understand similar to wireless keyboard used on traditional personal computers. Example the letter "a" is ASCII hex code 61 and key code is 97.
9. Transmitter 33 then modulates this keyboard code into a radio frequency RF signal of 2.4 GHz unlicensed radio spectrum, and transmits the signal to system processor 34. Or target 28 could use many other radio frequency spectrum then 2.4 GHz 802.15.4. Transmitter 33 could be licensed band used by satellite or cellular phone data providers and have an individual MAC and IP address similar to cell phone data connect. The unlicensed spectrum rf signal utilized has a legal range of approximately 30 ft or 10 meters or enough to reach the UBS transceiver 35 which is plugged into system processor 34.
10. The system processor 34 (e.g. laptop computer) upon receiving the signal through the USB transceiver 35 from target 28, under software 36 control tests whether the expected sub-target 28 is activated or not.
11. An audible sound from system processor 34 acknowledges a hit, and can also acknowledge a miss, with selectable sound effects (such as a high power gun sound for a hit, and the sound of a water splash for a miss). For example, assume that system processor 34 directed the shooter to shoot at target #3, If target #3 is hit within a predetermined period of time (e.g. 5 seconds), then system processor 34 emits an audible hit sound. However, if target #3 is not hit within the predetermined period of time, an audible miss sound will be emitted. Or, if another target (e.g. target #2) is hit instead of target #3, a miss sound will also be emitted.
12. At the conclusion of a training or game sequence, the shooter has an option of posting his/her score on the internet, simply save the score, or do nothing.

Scenario 2:

The shooter wants to randomly shoot at targets 28 with audible feedback and possibly on screen scoring, and saving or posting final results to the internet.

1. Shooter selects this particular game type from software 36 running on system processor 34 from a pull down menu.
2. Shooter aims with shooters discretion at any target 28 and gets back audible feedback of success or failure with shooter selected sound effects.
3. At the conclusion of training or game sequence, the shooter has the option to post the score to the internet, simply save the score, or do nothing.

Scenario 3:

As airsoft has many possible games scenarios, time accuracy aspects added to existing games played by airsoft players. Capture the flag and various death matches simulated war games and other training exercises were the target may not be on a target range but elsewhere in the field such as the flag itself.

In terms of use, a method for target shooting includes: (refer to FIGS. 1-19)

(a) providing a target shoot system 20 including:

a gun 22 which shoots a projectile 24;

a target assembly 26 including:

at least one target 28 having a projectile sensor 30 which produces an electronic signal when projectile 24 shot by gun 22 hits target 28;

a target information processor 32 connected to projectile sensor 30, target information processor 32 receiving and processing the electronic signal, and target information processor 32 including a transmitter 33 which transmits a target hit signal when a projectile 30 hits target 28;

a system processor 34 having a receiver 35 which receives the target hit signal from target information processor 32, and when the target hit signal is received outputs a target hit announcement; and, a target shooting system application program 36 which is installable on system processor 34, target shooting application program 34 for monitoring and controlling target shooting system 20 operation;

(b) installing target shooting system application program 36 on system processor 34;

(c) using gun 22 to shoot projectile 24 at target 28;

(d) projectile 30 hitting target 28 and target information processor 32 transmitting a target hit signal to system processor 34; and, (e) system processor 34 outputting a target hit announcement.

The method further including:

in (b), target shooting system application program 36 causing system processor 34 to display target shooting system information.

The method further including:

in (a), target assembly 26 including a plurality of targets 28 wherein each projectile sensor 30 is connected to target information processor 32; and, in (d), projectile 30 hitting one of the plurality of targets 28.

The method further including:

in (a), target information processor 32 including a debounce detector which detects when a single projectile hits two targets 28; and, in (d), debounce detector detecting if projectile 30 hits two targets 28.

The method further including:

in (d); target information processor transmitter 33 also transmitting a target ID along with the target hit signal; and, in (d), system processor 34 receiving the target ID along with the target hit signal.

The method further including:

in (d), system processor 34 receiving target hit signals and target IDs from a plurality of target assemblies 26.

The method further including:

in (e), the target hit announcement including at least one of (1) an audio announcement, and (2) a tactile announcement.

The method further including:

in (a), target shooting system 20 connected to the internet; and, in (b), target shooting system application program 36 accessed by going to an internet website.

The method further including:

prior to (c), providing an internet connection;

prior to (c), using the internet connection to connect system processor 34 to system processors 34 of other shooters; and, during (d), transmitting the target hit signal to the system processors 34 of other shooters.

The method further including:

in (a), target information processor 32 including a receiver 31, and system processor 34 including a transmitter 33; and, before (c), sending a target ID assignment from transmitter 33 of system processor 34 to receiver 31 of target information processor 32, the target ID assignment causing a target ID to be assigned to a target 28 by target information processor 32.

The method further including:

in (a), system processor 34 having a USB port;

in (a), receiver 31 of system processor 34 being a USB transceiver 35 which plugs into the USB port: and, prior to (c), plugging USB transceiver 35 into the USB port.

Figure 20:
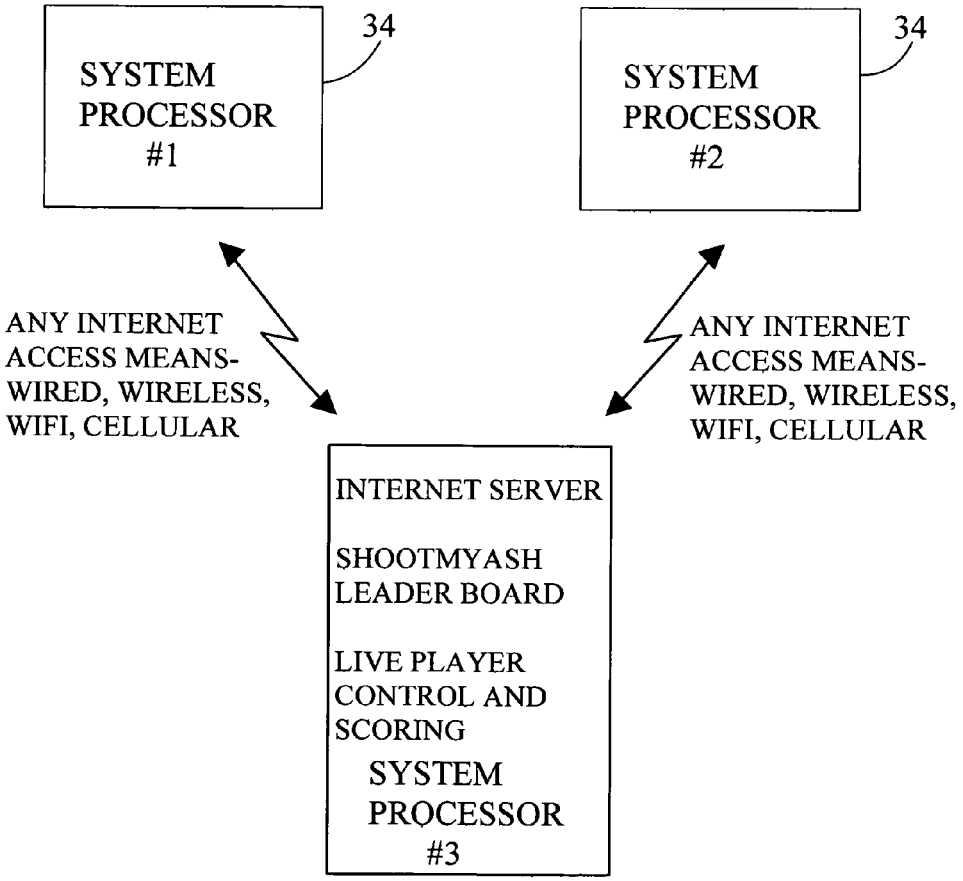
FIG. 20 is a block diagram of a first system network.

FIG. 20 is a block diagram of a first system network, which includes more than one system processor 34. Also referring to FIG. 15, as previously discussed a single system processor 34 can communicate with one to many target information processors 32. When there is more than one additional system processor 34 involved in overall scoring or competition the second or third or more system processors 34 may be in one of three configurations:

Close physical proximity: utilizing channel and addressing techniques discussed above Private network: wired or wireless networking of computers in a local area network Internet connection: two or more people playing live against each other or from internet server archives because of time zone differences.

System processor #1 can run one to may software applications at the same time: The basic software application is a browser pointing to a program for scoring and audible feedback of targets hit. The final score may be either saved locally or posted to a server locally or live on the internet.

System processor #2 is running the same software with the same functionality.

System processor #3 is either a dedicated computer, or a hosted internet service for storage of scores, people involved, guns used, range configuration, geo-location. System processor #3 may physically be a new dedicated computer or software running on either system process #1 or system processor #2.

When system processors 34 communicate to other commuters they are individually identifiable with a unique electronic serial number. When target information processors 32 talk to system processors 34 each individual target 28 is addressable by unique code on a unique channel. When system processors 34 with target information processors 32 are on the network each target 28 from each system processor 34 is individually known and therefore internet competition is possible.

Head 2 head: is real-time enhanced server software running on Computer 3. An embodiment utilizes Apache Web server which is the market leader in web serving software with more than 66% market share worldwide. This software allows a remote device with a browser to load and execute applications just like it was on the internet. An embodiment includes custom software which allows for scheduling of players and connecting those players in real time on the internet or private net.

Leader board is a hosted application on the internet for archiving scores of various players around the world for competition, entertainment and training purposes. This leader board is built from the software described above; web server, real-time communication module, data base for players, statistics, guns used, range configuration, target layout and other relevant target shooting information. Weather, winds, time . . . .

An operator will have some type of login and password for posting and retrieving local player's scores, new games created and scheduling for live play. A player would have some type of login and password means to post individual or team scores and schedule games.

Figure 21:
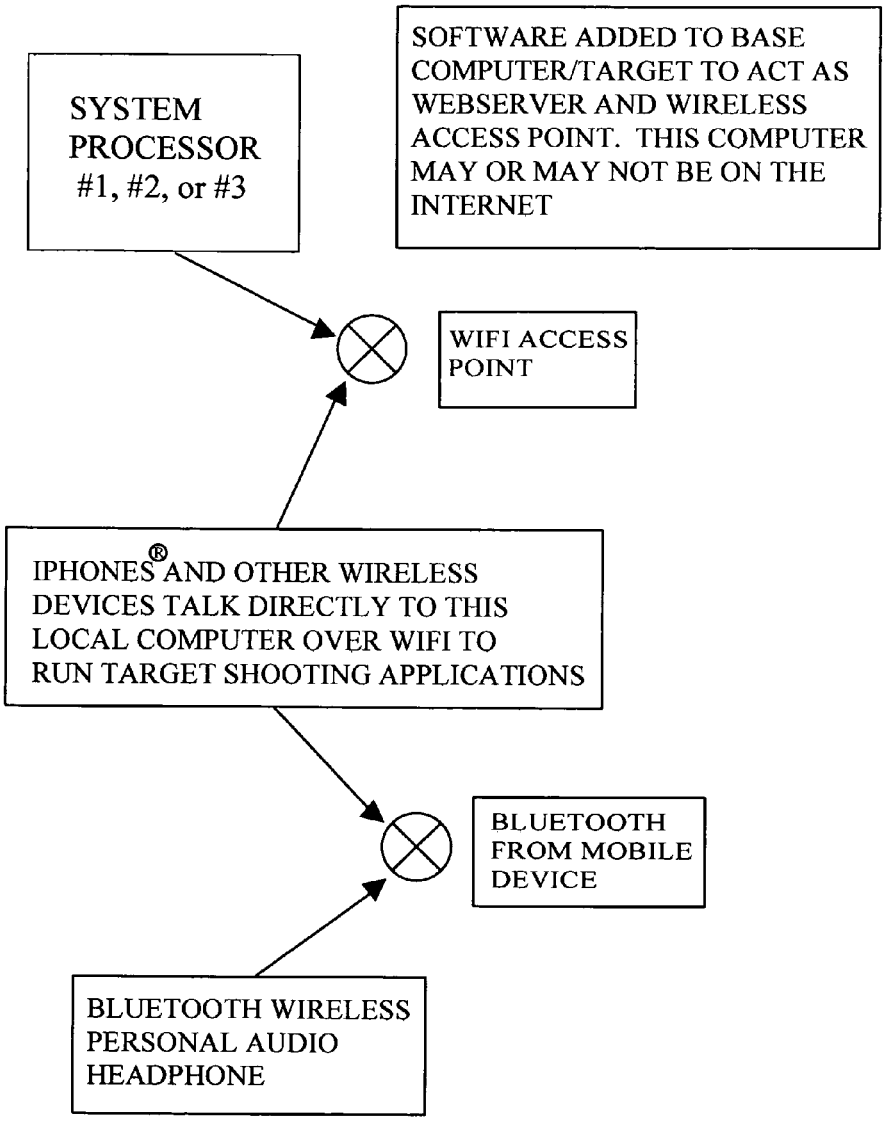
FIG. 21 is a block diagram of a second system network.

FIG. 21 is a block diagram of a second system network. Audio feedback and tactical feedback is critical to this invention. In the case of utilizing handheld devices like an iPhone and other Smartphone's without a physical connector to directly communicate to the target controller. System Processor #1, #2 or #3 in FIG. 21 may have Wifi build into the system processor and is activated by software as a hotspot or Wifi accesses point to allow many Wifi devices like iPhone to activate the application.

System processor #1, #2, or #3 in this case has been turned into a WiFi access point with only software to allow Wifi devices to communicate directly to a local handheld device like an iPhone. The iPhone points to the address of the computer #1 with the iPhone built-in browser and can play all games currently available.

AUDIO option: As audio output from an iPhone could be drowned out by local ambient noise the shooter may elect to use their Bluetooth headphone in FIG. 21 where a Wifi mobile device like an iPhone communicates with FIG. 21 systems processor #1, #2, or #3 over Wifi and communicates with the shooters personal Bluetooth device from the same iPhone believed to be carried in his pocket for feedback of what to shoot at next or feedback from previous shot.

The system processor and radio system co-exists with both Wifi and Bluetooth and allow this multi radio, multi standard system of target detection to system processor #1, and system processor #1 acting like a Wifi access point, communicating to a handheld device (probably in pocket) for further communication to a wireless Bluetooth headset.

The embodiments of the target shooting system and method of use described herein are exemplary and numerous modifications, combinations, variations, and rearrangements can be readily envisioned to achieve an equivalent result, all of which are intended to be embraced within the scope of the appended claims. Further, nothing in the above-provided discussions of the system and method should be construed as limiting the invention to a particular embodiment or combination of embodiments. The scope of the invention is best defined by the appended claims.

We claim:

1. A target shooting system, comprising:

a gun which shoots a physical projectile;

a target assembly including:

a plurality of targets, each of the plurality of targets having a respective projectile sensor connected to a respective striker plate, each projectile sensor producing an electronic signal, via a respective piezoelectric device, when said physical projectile shot by said gun hits a respective one of the plurality of targets; and a target information processor connected to each projectile sensor, said target information processor configured to receive and process said electronic signal, and said target information processor including a first transmitter configured to transmit a target hit signal and a unique target ID associated with the target of the plurality of targets generating said electronic signal, in response to receiving said electronic signal, when said physical projectile hits said associated target of the plurality of targets, said target information processor including a first receiver; and a system processor including (i) a second receiver configured to receive said target hit signal and said unique target ID from said target information processor and (ii) a second transmitter configured to transmit one or more signals to said first receiver of said target information processor, wherein upon receiving said target hit signal and said unique target ID from said transmitter of said target information processor, outputting a target hit announcement.

2. The target shooting system according to claim 1 wherein, said target information processor includes a debounce detector which detects when said physical projectile hits two of said plurality of targets.

3. The target shooting system according to claim 1 wherein, said second receiver of said system processor is configured to receive said target hit signal and unique target ID from a plurality of said targets.

4. The target shooting system according to claim 1, further including:

said striker plate having a front side and a rear side, said projectile sensor connected to said rear side of said striker plate.

5. The target shooting system according to claim 4, further including:

said striker plate fabricated from hardwood.

6. The target shooting system according to claim 4 wherein, said target assembly includes a frame to which said striker plate is removably connected; and said frame includes a cavity, such that that when said striker plate is connected to said frame, said projectile sensor is adjacent to said cavity.

7. The target shooting system according to claim 4 wherein, said striker plates connected to each of said projectile sensors are disposed in side-by-side spaced apart relationship.

8. The target shooting system according to claim 1 wherein, said target information processor includes an analog-to-digital converter which processes said electronic signal received from said projectile sensor.

9. The target shooting system according to claim 1 wherein, said target hit announcement includes at least one of (1) an audio announcement and (2) a tactile announcement.

10. The target shooting system according to claim 1 wherein, a target shooting system application program is installed on said system processor, said target shooting application program configured to monitor and control operations of said target shooting system.

11. The target shooting system according to claim 10 wherein, said target shooting system application program is accessed by going to an Internet website.

12. The target shooting system according to claim 10 wherein, said target shooting system application program causes said system processor to display target shooting system information.

13. The target shooting system according to claim 1 wherein, said system processor is configured to connect to other system processors of other target shooting systems via the Internet.

14. The target shooting system according to claim 1 wherein, said system processor includes a USB port; and said transmitter and said second receiver of said system processor are configured as a USB transceiver which plugs into said USB port.

15. The target shooting system according to claim 1, wherein, said one or more signals transmitted from said second transmitter include a target ID assignment signal, said target ID assignment signal causing target IDs to be assigned to the plurality of targets by said target information processor.

16. A method for target shooting, comprising:

(a) providing a target shooting system including:

(i) a gun which shoots a physical projectile;

(ii) a target assembly including:

(1) a plurality of targets, each of the plurality of targets having a respective projectile sensor connected to a respective striker plate, each projectile sensor producing an electronic signal, via a respective piezoelectric device, when said physical projectile shot by said gun hits a respective one of the plurality of targets;

(2) a target information processor connected to each projectile sensor, said target information processor configured to receive and process said electronic signal, and said target information processor including a first transmitter configured to transmit a target hit signal and a unique target ID associated with the target of the plurality of targets generating said electronic signal, in response to receiving said electronic signal, when said physical projectile hits said associated target of the plurality of targets, and said target information processor including a first receiver; and (iii) a system processor including a second receiver configured to receive said target hit signal and said unique target ID from said target information processor and a second transmitter configured to transmit one or more signals to said first receiver of said target information processor;

(b) installing a target shooting system application program on said system processor;

(c) using said gun to shoot said physical projectile at the plurality of targets;

(d) when said physical projectile hits at least one of the plurality of targets, said target information processor transmitting said target hit signal and said unique target ID associated with said at least one of the plurality of targets being hit by said physical projectile; and (e) upon said system processor receiving said target hit signal and said unique target ID associated with said at least one of the plurality of targets being hit by said physical projectile, outputting a target hit announcement.

17. The method of claim 16, wherein, said target shooting system application program is configured to display target shooting system information.

18. The method of claim 16, further comprising:

(f) the target information processor detecting when said physical projectile hits two of the plurality of targets using a debounce detector.

19. The method of claim 16 wherein, said second receiver of said system processor is configured to receive said target hit signal and unique target ID from a plurality of said targets.

20. The method of claim 16 wherein, said target hit announcement includes at least one of (1) an audio announcement and (2) a tactile announcement.

21. The method of claim 16, further comprising:

(f) connecting said target shooting system to the Internet; and (g) installing said target shooting application program on said system processor via said connection to the Internet.

22. The method of claim 16, further comprising:

(f) connecting said target shooting system to the Internet; and (g) using the Internet to connect said system processor to one or more system processors of other target shooting systems;

(h) transmitting one or more of said target hit signals to said system processors of other target shooting systems.

23. The method of claim 16, further comprising:

(f) using said second transmitter to transmit a target ID assignment signal to said first receiver, said target ID assignment signal causing target IDs to be assigned to the plurality of targets by said target information processor.

24. The method of claim 16, further comprising:

(f) plugging in a USB transceiver into a USB port of said system processor prior to using said gun at step (c).

* * * * *

UNITED STATES PATENT AND TRADEMARK OFFICE

CERTIFICATE OF CORRECTION

PATENT NO. : 8,523,185 B1
APPLICATION NO. : 13/374258
DATED : September 3, 2013
INVENTOR(S) : Don Herbert Gilbreath et al.

It is certified that error appears in the above-identified patent and that said Letters Patent is hereby corrected as shown below:

In the Claims

Col 13, line 55 delete the second "that"

Signed and Sealed this
Twenty-eighth Day of January, 2014

Michelle K. Lee

Michelle K. Lee
*Deputy Director of the United States Patent and Trademark Office*